United States Patent [19]

Shultz et al.

[11] Patent Number: 4,813,600

[45] Date of Patent: Mar. 21, 1989

[54] SIMPLIFIED PRESSURE TIME DEPENDENT FUEL INJECTOR

[75] Inventors: David E. Shultz; George L. Muntean; Kevin L. Vogt, all of Columbus, Ind.

[73] Assignee: Cummins Engine Company, Inc., Columbus, Ind.

[21] Appl. No.: 109,048

[22] Filed: Oct. 16, 1987

[51] Int. Cl.[4] ..... F02M 47/00

[52] U.S. Cl. ..... 239/88; 239/125; 239/533.3

[58] Field of Search ..... 239/88–96, 239/132.1, 132.3, 132.5, 124, 125, 533.2–533.12

[56] References Cited

U.S. PATENT DOCUMENTS

| | | | |
|---|---|---|---|
| 2,350,434 | 6/1944 | Wallgren et al. . | |
| 2,468,824 | 5/1949 | Hughey . | |
| 2,521,224 | 9/1950 | Kammer | 239/88 |
| 3,093,317 | 6/1963 | Simmons et al. | 239/533.2 X |
| 3,146,949 | 9/1964 | Reiners | 239/533.7 X |
| 3,339,848 | 9/1967 | Geiger | 239/533.4 X |
| 3,406,912 | 10/1968 | Claffey | 239/533.3 |
| 4,280,659 | 7/1981 | Gaal et al. | 239/124 |
| 4,410,138 | 10/1983 | Peters et al. | 239/95 |
| 4,441,654 | 4/1984 | Peters | 239/89 |
| 4,552,310 | 11/1985 | Gaskell | 239/533.5 |
| 4,635,853 | 1/1987 | Mowbray | 239/533.3 |
| 4,703,142 | 10/1987 | Dzewaltowski et al. | 239/533.3 X |

FOREIGN PATENT DOCUMENTS

| | | | |
|---|---|---|---|
| 165629 | 3/1950 | Austria | 239/533.3 |

*Primary Examiner*—Andres Kashnikow
*Assistant Examiner*—Mary Beth O. Jones
*Attorney, Agent, or Firm*—Sixbey, Friedman, Leedom & Ferguson

[57] ABSTRACT

An improved, simplified pressure/time dependent fuel injector assembly for injecting fuel intermittently into a combustion chamber of an internal combustion engine. The injector assembly includes a unitary or single-piece injector body which has at least one groove-like channel on the exterior surface thereof. The channel is closed and sealed by a sleeve which is press-fit about that portion of the injector body on which the channel lies. For reciprocation within the injector body, there is provided an injector-plunger assembly which includes a top stop mechanism for adjustably setting the distance traveled by the plunger assembly during the reciprocatory movement thereof.

11 Claims, 2 Drawing Sheets

SIMPLIFIED PRESSURE TIME DEPENDENT FUEL INJECTOR

TECHNICAL FIELD

This invention relates to fuel injector assemblies for intermittently injecting fuel into the combustion cylinder of an internal combustion engine. In particular, the present invention provides a pressure/time dependent fuel injector assembly which meets stringent performance standards but is economical to produce.

BACKGROUND ART

Because of widely recognized fuel economy and performance advantages, fuel injectors are enjoying expanded use in internal combustion engines. In most instances, however, the manufacture of fuel injectors has involved a compromise between manufacturing cost and desired performance capabilities. In some cases, it has been necessary to sacrifice simplicity to achieve necessary or desired performance goals. For example, U.S. Pat. No. 2,350,434 (to Wallgren et al) discloses a fuel plunger pump combined with an injector nozzle wherein by virtue of rotatable sleeves, the effective length of the pump stroke may be varied to accommodate changing operational conditions. However, this desired performance requires a complicated design including a series of interconnected recesses, bores and passages in and through the plunger, the multiple sleeves and the multipart casing.

U.S. Pat. No. 4,280,659 to Gaal et al discloses a fuel injector assembly designed to achieve improved operation including an injector body, a barrel, and a cup positioned in an end-to-end relation wherein special precautions are required to avoid fuel leakage from the machined interfaces between, for example, the injector cup and the barrel. Despite expensive, high tolerance machining of the components forming the assembly, Gaal et al require that an additional annular groove be formed between the cup and the barrel to control fuel seepage, further complicating the structure and the manufacturing process thereof.

U.S. Pat. No. 4,410,138 to Peters et al (assigned to Cummins Engine Company, Inc.) attempts to solve the problem of complexity in fuel injector assemblies by eliminating axial fuel passages from the two piece injector body. However, the disclosed design will require the body to be formed in two parts which must be subsequently joined. The injector plunger is also formed with an internal flow passage for scavenging fuel flow which further increases the cost and complexity of this design.

A second patent to Peters (U.S. Pat. No. 4,441,654 also assigned to Cummins Engine Company, Inc.) discloses another attempt to form a simplified fuel injector but again the disclosed design requires a two part body which must be permanently joined together thereby complicating the manufacturing process. Like U.S. Pat. No. 4,410,138, the Peters '654 patent discloses the advantages of reducing or eliminating axial drilling by using only radial passages to connect the central axial bore with the exterior of the injector body to provide flow passages between the fuel supply/drain systems of the engine and the interior of the injector. This design, however, constrains the location of the common fuel supply rail and the fuel drain rail to positions corresponding to locations of the corresponding radial passages contained in the injector body. Such rail locations may not be ideal in a given engine head design.

Attempts to simplify the formation of longitudinal passages in mechanical devices other than fuel injectors are known. For example, U.S. Pat. No. 2,468,824 to Hughey discloses a method for making a tip for a gas torch in which passages are provided by milling longitudinal slots on a central core piece or insert and completing the passages with a long sleeve fitted tightly about the insert. Although suitable for the purposes disclosed, there is no suggestion of how this technique might be employed to simplify the design of a fuel injector without sacrifice of important performance goals for the injector.

While the disclosures and teachings of the above-noted patents evidence some progress, a fuel injector assembly which is simple and inexpensive to manufacture and use has, nevertheless, remained an allusive objective.

DISCLOSURE OF THE INVENTION

The first and major object of the present invention is to accomplish the seemingly contradictory goals of providing a fuel injector assembly which is both simple in structure and yet is able to accomplish performance goals which have heretofor required a far more complex structure.

Another object of the present invention is to provide a simplified pressure/time fuel injector assembly including a simplified single-piece injector body for providing a fuel flow path which has at least one, axial, groove-like channel on the exterior surface thereof which is sealed and closed by a sleeve which encompasses that portion of the fuel injectory body having the groove-like channel thereon.

An additional object of the present invention is to provide a simplified pressure/time fuel injector assembly including a single-piece injector body for providing a fuel flow path which has an undercut to facilitiate accurate injection formation and which is later filled to overcome injector performance problems. The single piece injector body design also includes an easily formed check valve arrangement to ensure that fuel flows only in a desired direction.

Another specific object of the present invention is to provide a simplified pressure/time dependent fuel injector assembly including a simplified single-piece injector body containing a central axial bore for receiving an injector plunger and means for supplying fuel to and draining fuel from the central axial bore through flow paths formed by radial passages and groove-like axial channels contained in the exterior surface of the injector body. The assembly further includes a sleeve positioned about the surface of the injector body to close and seal the groove-like channel to form one portion of the flow paths for fuel into and out of the central axial bore. Injector plunger travel is limited by a top stop arrangement adapted to permit adjustment of the plunger travel by selection of a desired shim thickness. Further and more specific objects of the present invention may be understood from the following brief description of the drawings and from the best mode for carrying out the invention.

BEST DESCRIPTION OF THE DRAWINGS

BEST MODE FOR CARRYING OUT THE INVENTION

Figure 1A:
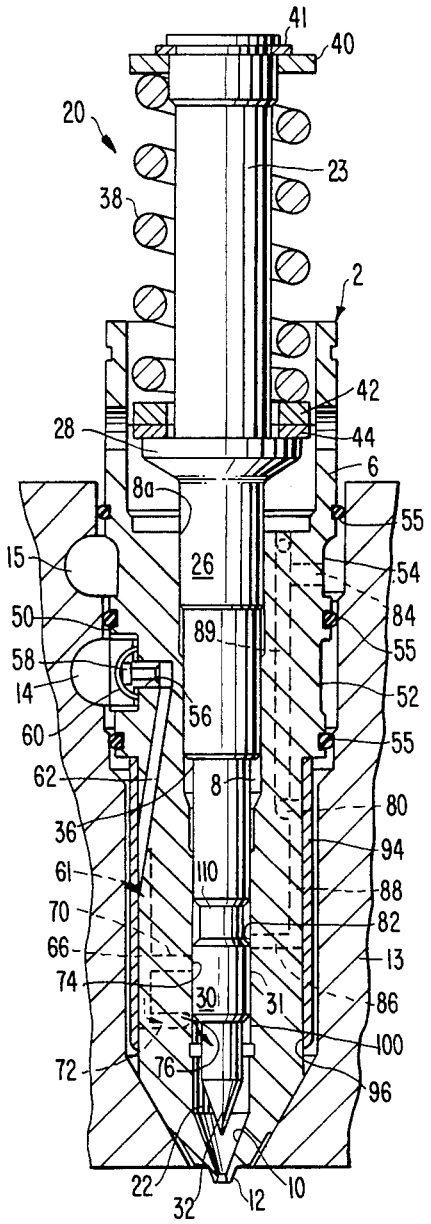
FIGS. 1A and 1B are cross-sectional views of the fuel injector assembly designed in accordance with the present invention shown in different operational positions occurring during an injection cycle.

For the purpose of providing an understanding of the principles and advantages of this invention, reference is made to the Figures which illustrate and identify the elements of a simplified pressure/time dependent fuel injector assembly designed in accordance with the subject invention for use in intermittently injecting fuel into a combustion chamber of an internal combustion engine. In particular, FIG. 1A discloses a fuel injector assembly, indicated generally at 2, including an injector body 6 containing a central axial bore 8 open at its upper end 8*a*. At the other end of the injector body, there is a cone-shaped plunger seat area 10 and an injection orifice 12 through which fuel passes from the lower end of the axial bore 8 into an engine combustion chamber, not illustrated.

The injector body 6 thus far described is designed to be mounted in a recess formed in head 13 (only partially shown) of an internal combustion engine. External fuel supply and drainage are provided for the fuel injector assembly through an external fuel supply passage 14 and a fuel drain passage 15 contained entirely within the head 13. Specifically, the supply passage 14 (sometimes referred to as a common rail) is provided to supply fuel to the fuel injector assembly and drain passage 15 is adapted to receive that portion of the fuel flowing through the injector assembly which is not injected into the combustion chamber for return to the fuel supply system.

Figure 1B:
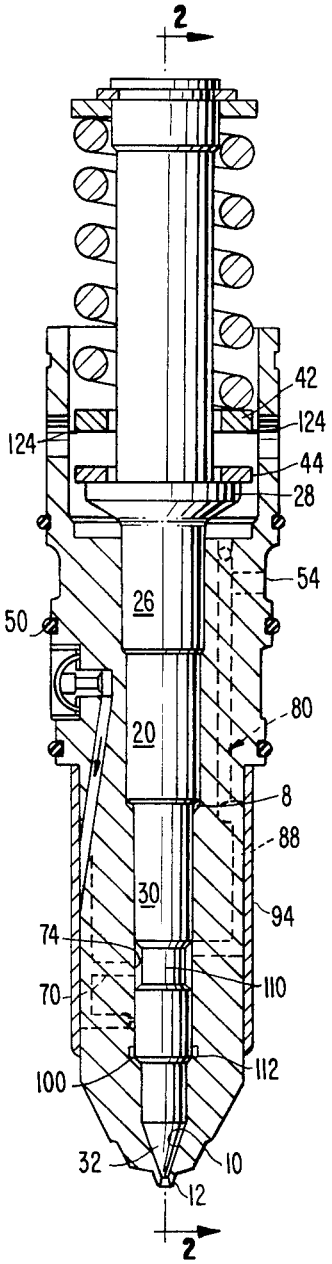

As further shown in FIGS. 1A and 1B, central axial bore 8 is adapted to receive a plunger assembly indicated generally at 20. When in place, the plunger assembly 20 and the injector body 6 cooperate to form an injection chamber 22 at the end of the central bore 8 for receiving fuel for injection into the combustion chamber as more fully explained hereinafter. The plunger assembly 20 includes an upper link section 23, a lower plunger section 30 and a coupling 26, having a coupling flange 28. Section 23 and 30 may be formed separately and combined. The lower plunger section 30 includes a cone shaped tip 32. In addition, the plunger assembly includes a return spring 38 connected to the upper link section 23 by a plunger spring retainer 40 (and retaining ring 41) for biasing the plunger assembly away from the injection orifice 12. Engaging the lower end of spring 38 is a lower washer 42 and an adjustment shim or spacer 44. The upper limit of travel of the injector plunger assembly 20 may be changed by replacing a given adjustment shim with a shim of different thickness. More particularly, the flange 28, washer 42 and shim 44 form a top stop means for momentarily unloading the injector actuating train (not illustrated). By unloading the train, the various wear joints may take on lubrication due to capillary action at the joints. The plunger assembly travel is limited at its upper end when flange 28 on the plunger coupling 26 comes into contact with lower washer 42 which in turn rests on surface 124 of the injector body (see FIG. 2). It can, thus, be appreciated that the upper limit of plunger travel can be adjusted by replacing using a shim 44 with a shim of different thickness to accommodate different injector actuating trains or wear which may take place within a given train.

The fuel flow from the fuel supply passage 14 (the common rail) into injection chamber 22 and from there into the combustion chamber (not shown) through orifice 12 will now be further explained by reference to FIGS. 1A and 1B. The exterior surface 50 of the injector body 6 has an annular fuel supply recess 52 and an annular fuel drain recess 54 axially spaced from one another. The supply and drain recesses are axially sealed when the injector body 6 is placed within the injector receiving recess of head 13 by O-rings 55 retained in small annular grooves formed in body 6 above and below each annular recess.

The injector body 6 has a fuel supply opening 56 which opens into the annular fuel supply recess 52. A metering plug 58 may be mounted in the opening and a screen 60 may be provided over the fuel supply opening to ensure that no particulate contaminants enter the fuel flow through the injector body.

Connecting fuel supply opening 56 with the injection chamber 22 is a fuel supply pathway 61 including an oblique passage 62 and cross passage 65 (not shown in FIG. 1A). Pathway 61 extends from opening 56 to the upper end of an axially extending groove-like supply channel 66 (shown out of plane in dashed lines contained in the injector body 6. Channel 66 opens into the exterior surface of the injectory body 6. Near the lower end of channel 66 is a pair of radial passages 70 and 72 (shown out of plane in dashed lines) extending into the central axial bore 8. Upper radial passage 70 terminates at a scavenging port 74 to permit flow of fuel into the central bore under the control of the injector plunger assembly 20 for scavenging and cooling purposes as will be explained more fully below. Similarly, lower radial passage 72 terminates at a metering orifice 76 through which fuel is metered into the injection chamber under the control of the injector plunger assembly 20.

Fuel drains from the disclosed injector assembly by means of a fuel drain pathway 80 which extends from a drain port 82, communicating with central bore 8 and a drain opening 84 opening into annular drain recess 54. Both the drain port 82 and the scavenging port 74 are located axially further from the injection orifice 12 of the injector body then metering orifice 76. Fuel drain pathway 80 includes radial passage 86 extending from drain port 82 to the lower end of an axially extending, groove-like drain channel 88 contained in the injector body 6 and opening into the interior surface of the injector body 6. An axial passage 89 connects the upper end of drain channel 88 with drain opening 84 to complete the fuel drain pathway 80 from drain port 82.

All of the fuel flow passage and pathways including recesses 52 and 54, as well as pathways 61 and 80, form a fuel transfer means for fuel flowing into or out of the central axial bore 8.

The supply channel 66 and drain channel 88 contained in the exterior surface of injectory body 6 are sealed by a closure sleeve 94 formed as a generally cylindrical tubular member having an inner surface 96 whose diameter is formed to cause the sleeve 94 to frictionally and circumferentially encompass that portion of the injector body surface which contains supply channel 66 and drain channel 88. The sleeve 94 may be of any cross-sectional shape, but a cylindrical exterior is preferred for interference fitting the exterior surface of the injector body 6. A variety of methods may be employed to assure the integrity of the seal around each groove-like channel. For example, a heat shrink process could be employed to cause closure sleeve 94 to grip the exterior of injector body 6 with sufficient force to assure seal integrity. Alternatively, a predetermined interference could be manufactured between the exterior diameter of body 6 and the interior diameter of sleeve 94. Thus sleeve 94 could be forced over the exterior of body 6 to form the desired seal. An interference of 0.00075–0.00125 inch with parts at same temperature is preferred.

Figure 2:
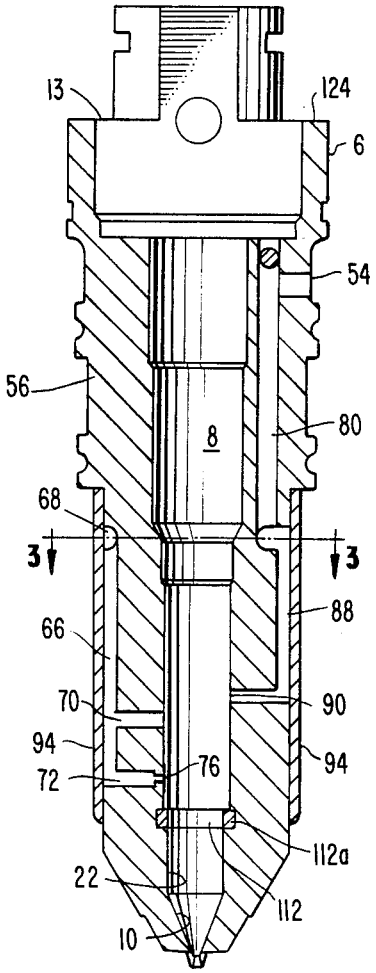
FIG. 2 is a cross-sectional view of the injector body of the present invention taken along lines 2—2 of FIG. 1B without the injector plunger.
Figure 4:
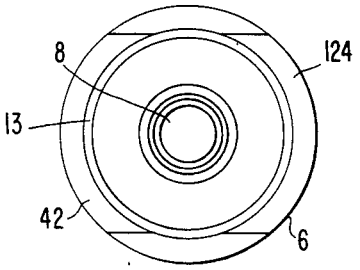
FIG. 4 is a top elevational view of the fuel injector body of the present invention.
Figure 5:
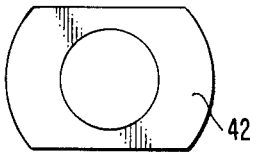
FIG. 5 is an top elevational view of the lower washer of the fuel injector assembly of the present invention.
Figure 3:
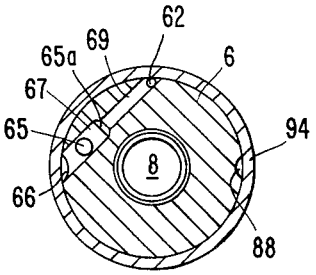
FIG. 3 is a transverse cross-sectional view taken through the fuel injector body of the present invention taken along line 3—3 of FIG. 2.
Figure 6:
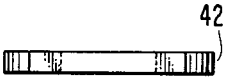
FIG. 6 is a side elevational view of the top stop washer means shown in FIG. 5.

FIG. 2 is a cross-sectional view, taken through the fuel injector body of the present invention without the injector plunger assembly in place, which shows a portion of the fuel supply and drain pathways provided by the injector body of the present invention. FIG. 3, a transverse sectional view taken along line 3—3 of FIG. 2, shows a cross passage 65 which is adapted to connect the lower end of oblique passage 62 with the upper end of supply channel 66. Cross passage 65 includes an enlarged portion 67 communicating with supply channel 66 at one end and communicating at its other end with a small diameter portion 69 of cross passage 65 to form a valve seat **65*a* which receives a ball 65. Ball 65 engages seat 65*a* whenever fuel tries to flow from channel 66 back to passage 62. This ball 65 and passage 67 act as a check valve to ensure that fuel, under pressure, flows only in the direction away from the fuel supply recess 52 toward the injection chamber 22 or, during the scavenging portion of the injector cycle (described below), toward the scavenging port 74**.

As previously stated, the injector plunger assembly 20 is designed to reciprocate within the central axial bore 8 of the injector body 6, and it is this reciprocating motion which provides for the intermittent discharge of fuel from the injection chamber 22 into the combustion chamber of the internal combustion engine. Regarding the operation of the injector herein described, reference is first made to the position of the injector plunger assembly as shown in FIG. 1A. It can be seen that a land 31 is formed on the the lower plunger section 30. The land 31 is sized to have a clearance within base 8 which is so small as to effectively seal the sections of bore 8 above and below land 31. From FIG. 1, it is apparent that land 31 is positioned along the axial length of the plunger assembly to close scavenging port 74 while leaving the metering orifice 76 open when the plunger assembly is at its upper limit of travel as illustrated. Fuel under pressure flows from the annular supply recess 52 into the internal fuel supply pathway 61 including oblique passage 62, cross passage 65 (not illustrated), supply channel 66, radial passage 72 and metering orifice 76 into the injection chamber 22. The quantity of fuel flowing into the injection chamber 22 during each full injector cycle or reciprocation is a function of the pressure of the fuel supply in the common rail and of the length of time the plunger assembly is in the position just described. At the end of the metering portion of the injector cycle, the injector actuating mechanism (not shown) drives the plunger assembly 20 toward the combustion chamber in an injection stroke. As the plunger assembly moves toward the combustion chamber, the lower edge 100 of land 31 descends past the metering orifice 76 and traps the fuel in the injection chamber. As the plunger assembly 20 continues to move towards the combustion chamber 22, it exerts pressure on the fuel trapped in the injection chamber 22 and displaces the fuel from the chamber 22 through the injection orifice 12 and into the combustion chamber.

As shown in FIG. 1B, when the injector assembly reaches the plunger seat 10 and completes the injection stroke, the scavenging groove 110 formed in the injector plunger assembly 20 above land 31 comes into operation. That is, the upper edge of land 31 moves downwardly past the scavenging port 74 to allow fuel to flow through upper radial passage 70 and into the scavenging groove 110 formed in the lower plunger section 30. This scavenging flow is connected to the annular fuel drain recess 54 by the drain pathway 80. Once the injector has reached its innermost position, further fuel flow to the combustion chamber will cease; however, fuel will still flow through the injector body, more paticularly, through the central axial bore 8 of the injector body 6, to provide the scavenging and cooling function. The need for this scavenging and cooling function is thoroughly discussed in commonly assigned U.S. Pat. No. 4,441,654.

From the above description of the operation of the fuel injector assembly of the present invention, it can be seen that the amount of fuel which flows into the injection chamber under pressure is dependent upon the length of time that the metering orifice remains open to the injection chamber and the pressure of the fuel supplied to the injector through supply passage 14. That time is in turn dependent upon the shape of the cam driving the injector plunger assembly and the speed of the engine. Upon further examination of plunger assembly 20, it should be noted that this travel distance may be controlled by the injector assembly top stop washer 42 and top stop shim 44. The shim is positioned between the coupling flange 28 and the top stop washer 42 which rests upon the injector body stop surface 124. The shim thickness may be selected to compensate for slight variations in component dimensions of the injector assembly of the present invention occasioned by the production and/or machining process.

To achieve one of the important advantages of the disclosed simplified injector design, it is important to be able to form the injector body 6 as a single element. Certain manufacturing problems arise, however, from this constraint. In particular, it is important to form combustion chamber 22 to very exacting tolerances which require a grinder relief undercut 112 (FIG. 2). Once formed, this undercut 112 causes the injector volume to be excessive and can lead to performance problems. Undercut 112 can be filed by a variety of options such as rolling or wedging a soft steel bushing **112*a* (FIG. 2) into the undercut 112 or releasing a split spring steel ring (not illustrated) into the undercut 112**.

While it is known to provide a fuel injector assembly which provides a metered quantity of fuel to a combustion chamber and which also provides for a scavenging flow through the injector to cool the injector body or to remove gases which may have entered the fuel supply line, such injectors typically in the past have utilized an extremely complex arrangement of passages involving a plurality of axial and radial bores or passages in a multipart body.

Moreover, the subject injector design does not require close machine tolerances for component interfaces as is required by previous fuel injector assemblies which require injector bodies composed of multiple pieces. Because the injector body 6 is a single piece body, the fuel seepage or leakage problem between components used in the past to form an injector body, heretofore unsolved except by provision of additional drain passages or grooves between body assembly components, is obviated. As can be seen from the Figures and the description of the injector assembly of the present invention, the fuel injector assembly described herein is a novel and substantial innovation and attains all of the previously stated objects.

INDUSTRIAL APPLICABILITY

The simplified pressure/time dependent fuel injector assembly described herein will find application in a wide range of diesel and gasoline internal combustion engines in almost every field of use. The simplicity exhibited by the present fuel injector assembly w ill substantially reduce manufacturing costs while insuring that performance requirements are met.

We claim:

1. A fuel injector assembly for injecting fuel intermittently into a combustion chamber of an internal combustion engine comprising:

an injector body having a central axial bore and an injection orifice at one end thereof connecting said central axial bore with the combustion chamber, said injector body containing a fuel transfer means for forming a flow path for fuel into our out of said central axial bore, said fuel transfer means including at least a first groove-like channel on the external surface of said injector body and including a first passage connecting said first groove-like channel with said central axial bore;

sleeve means positioned about the outer surface of said injector body to close and seal said groove-like channel to form one portion of said fuel flow path; and an injector plunger assembly, mounted within said central axial bore to form an injection chamber communicating with said injection orifice and for intermittent reciprocation within said central axial bore of said injector body to provide intermittent injection of fuel from said injection chamber through said injection orifice into the combustion chamber; wherein said fuel transfer means includes an annular fuel supply recess on the exterior surface of said injector body, and a fuel supply pathway connected at one end to said annular fuel supply recess and at its opposite end to said central axial bore, said pathway including said first groove-like channel on the external surface of said injector body, and wherein said fuel transfer means further includes an annular fuel drain recess on the exterior surface of said injector body, and a fuel drain pathway connected at one end to said annular fuel drain recess and at its opposite end to said central axial bore, said drain pathway including a second groove-like channel on the external surface of said injector body.

2. The fuel injector assembly of claim 1, wherein said groove-like channels on the exterior surface of said injector body are generally parallel to the central, longitudinal axis of said injector body and extend generally axially on the exterior surface thereof.

3. The fuel injector assembly of claim 2, wherein said sleeve means has an inner surface adapted to be interference fit to the outer surface of said injector body.

4. The fuel injector assembly of claim 2, wherein said annular supply and drain recesses are sealingly separated by an O-ring seal.

5. The fuel injector assembly of claim 1, wherein said injector plunger assembly includes:

a top stop means for selectively setting the upper limit of travel of said plunger assembly during the reciprocating movement thereof.

6. The fuel injector assembly of claim 5, wherein said injector plunger assembly includes an injection plunger mounted for reciprocal movement within said central axis bore, said injection plunger having a flange to limit the extent of movement of said injection plunger, and a return spring encircling the portion of said injection plunger between said flange and the end of said injection plunger which is remote from said injection chamber, and wherein said top stop means includes a washer located between said return spring and said flange, said washer extending into contact with said injector body to cause said return spring to be compressed when said injection plunger moves toward said injection chamber.

7. The fuel injector assembly of claim 6, wherein said top stop means includes an adjustment shim located between said flange and said washer, the thickness of said shim limiting said plunger travel within said central axial bore to a predetermined distance.

8. The fuel injector assembly of claim 7, wherein said injection plunger includes a scavenging groove.

9. The fuel injector assembly of claim 1, wherein said injector body contains an undercut in said central axial bore adjacent said injection chamber, said undercut being filled by means of an insert.

10. A fuel injector assembly for injecting fuel intermittently into a combustion chamber of an internal combustion engine comprising:

an injector body having a central axial bore and an injection orifice at one end thereof connecting said central axial bore with the combustion chamber, said injector body containing a fuel transfer means for forming a flow path for fuel into or out of said central axial bore, said fuel transfer means including at least a first groove-like channel on the external surface of said injector body and including a first passage connecting said first groove-like channel with said central axial bore;

sleeve means positioned about the outer surface of said injector body to close and seal said groove-like channel to form one portion of said fuel flow path; and an injector plunger assembly, mounted within said central axial bore to form an injection chamber communicating with said injection orifice and for intermittent reciprocation within said central axial bore of said injector body to provide intermittent injection of fuel from said injection chamber through said injection orifice into the combustion chamber; wherein said fuel transfer means includes an annular fuel supply recess on the exterior surface of said injector body, and a fuel supply pathway connected at one end to said annular fuel supply recess and at its opposite end to said central axial bore, said pathway including said first groove-like channel on the external surface of said injector body, and wherein said fuel supply pathway includes a first passage extending from said annular fuel supply recess to a point circumferentially spaced from said first groove-like channel and a cross passage extending from said first passage to said first groove-like channel, said cross passage being oriented in a plane generally perpendicular to the central longitudinal axis of said central axis bore.

11. The fuel injector assembly of claim 10 wherein said cross passage is larger in diameter at the end connecting with said first groove like channel, and wherein said injector assembly includes a valve element located in said large diameter end of said cross passage, said valve element being held in place by said sleeve means to form a one way valve.

* * * * *